United States Patent [19]

Burnside et al.

[11] 4,029,443

[45] June 14, 1977

[54] PROGRESSING CAVITY PUMP

[75] Inventors: Chester C. Burnside, Aiken, S.C.; John G. Wright, Coplay, Pa.

[73] Assignee: Olin Corporation, New Haven, Conn.

[22] Filed: Nov. 27, 1974

[21] Appl. No.: 527,818

[52] U.S. Cl. ..... 418/48; 92/170; 418/153

[51] Int. Cl.[2] ..... F01C 5/04; F04C 1/06; F04C 5/00

[58] Field of Search ..... 418/48, 152, 153; 92/170, 171, 169

[56] References Cited

UNITED STATES PATENTS

| | | | |
|---|---|---|---|
| 1,456,171 | 5/1923 | Woodward | 92/171 |
| 1,529,911 | 3/1925 | Norling | 92/171 X |
| 2,527,670 | 10/1950 | Allen | 418/48 |
| 2,826,152 | 3/1958 | Michie | 418/48 |
| 3,439,586 | 4/1969 | Holtan et al. | 92/169 |
| 3,479,960 | 11/1969 | Cardoso | 418/48 X |

FOREIGN PATENTS OR APPLICATIONS

| | | | |
|---|---|---|---|
| 842,484 | 7/1960 | United Kingdom | 418/48 |

*Primary Examiner*—Irwin C. Cohen
*Attorney, Agent, or Firm*—James B. Haglind; Donald F. Clements; Thomas P. O'Day

[57] ABSTRACT

An improved progressing cavity pump of the Moineau type having a helically externally threaded rotor coacting with an internally helically threaded stator. In a Moineau pump where the pump casing is a singular tubular unit, the stator is bonded to the casing with an adhesive. When the pumps are used with a corrosive fluid, such as caustic soda, the adhesive is attacked and the stator becomes free to rotate. To prevent the stator from rotating, a rib is attached along a portion of the casing. The rib restrains the stator and prevents its rotation.

2 Claims, 5 Drawing Figures

PROGRESSING CAVITY PUMP

This invention relates to progressing cavity type pump construction. It relates particularly to improvements in Moineau-type pumps having a helically externally threaded rotor coacting with an internally helically threaded stator.

Pumps of the type generally known as Moineau or Moyno are available commercially and are built with a singlethreaded metallic rotor which is rigid and a double-threaded helical stator which is of a flexible material such as rubber. The stator is attached to a tubular casing by means of an adhesive.

The pumps are particularly used to pump highly abrasive fluids or corrosive fluids such as caustic soda. When used with caustic soda, the adhesive bonding the stator to the casing is chemically attached by the caustic soda and the stator is then free to rotate. Rotation physically damages the stator and replacement is soon required.

One method of preventing the stator from rotating is described in U.S. Pat. No. 2,796,029, issued June 18, 1957 to Bourke. In this patent, the pump casing is in two sections with the upper part being bolted to the lower part. The stator is molded to provide lateral extensions. The extensions are clamped in position when the two sections of the casing are bolted together. Molding of the stator to provide lateral extensions requires an additional operation and increases the cost of producing the pump.

In addition, this method is not applicable where the pump casing is a singular, tubular unit with the stator adhesively bonded to the casing. An improved method is thus required for preventing the stator from rotating.

It is therefore an object of the present invention to provide an improved apparatus for retaining the stator in a fixed position.

It is a further object of the present invention to provide an improved progressive cavity pump suitable for use with corrosive fluids.

An additional object of the present invention is to provide an improved progressive cavity pump where the casing serves as a mold for the stator.

These and other objects of this invention are accomplished in a helical gear pump wherein an internally helically threaded resilient stator pumpingly coacts with an externally helically threaded rotor where a rigid tubular casing embraces the stator; the improvement which comprises attaching at least one rib along the length of the casing with the rib restraining the stator to prevent the stator from rotating within the casing.

The improved apparatus of the present invention is illustrated in the accompanying FIGS. 1–5. Corresponding parts have the same numbers in all Figures.

Figure 1:
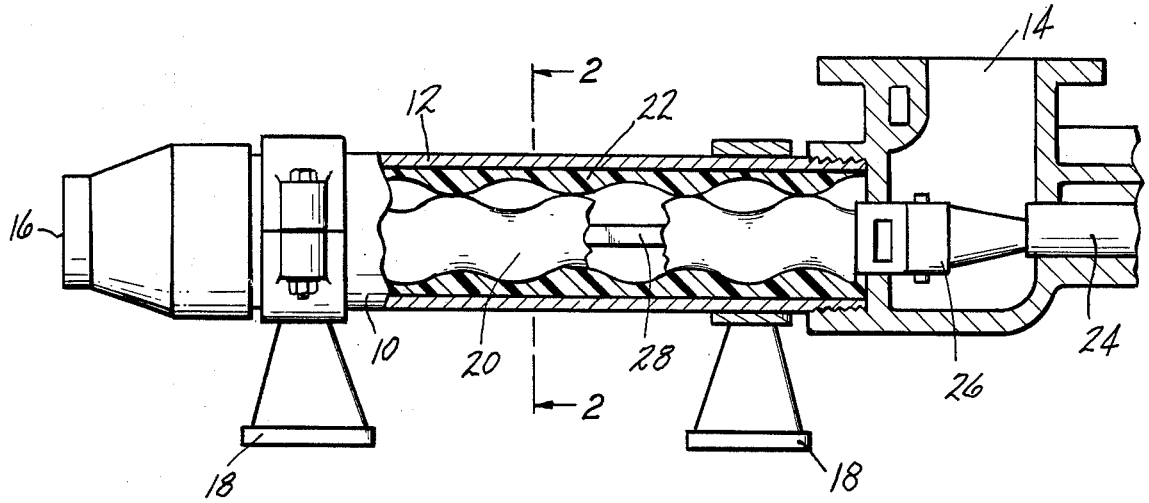
FIG. 1 illustrates an elevational view partially sectioned with portions cut away of a typical Moineau pump having the improvement of the present invention.

Referring to FIG. 1, pump 10 has a casing 12, inlet 14, outlet 16 and mounting brackets 18. The pumping mechanism comprises a rotor 20 which is generally a rigid material and a stator 22 which is a flexible material such as rubber. Rotor 20 operates within stator 22.

Rotor 20 is connected to drive shaft 24 by means of a universal joint generally indicated as 26. Casing 12 is provided with at least one rib 28 running lengthwise along the inner wall of casing 12.

Figure 2:
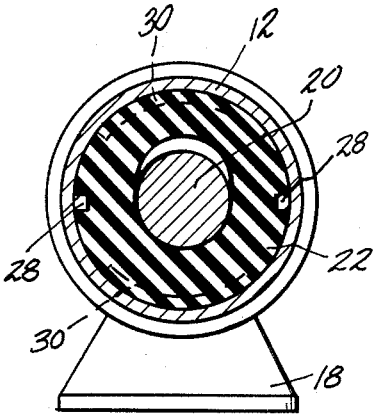
FIG. 2 shows an enlarged cross sectional view taken along line 2—2 of FIG. 1.
Figure 3:
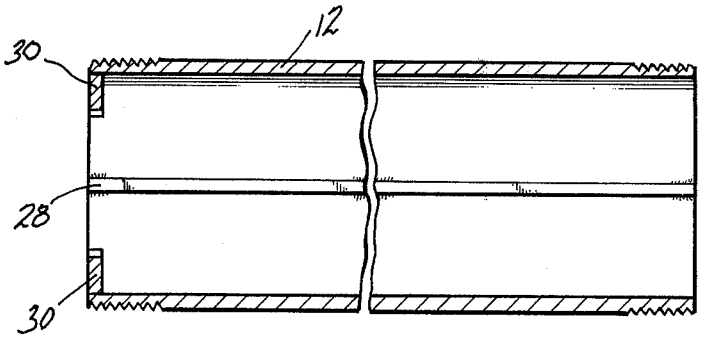
FIG. 3 shows a cross section of the pump casing with the improvement of the present invention.

As shown in FIG. 2, ribs 28 prevent stator 22 from turning during the operation of rotor 20. In addition, curbs 30 prevent stator 22 from being forced out of casing 12 through outlet 16 during operation of the pump.

Figure 4:
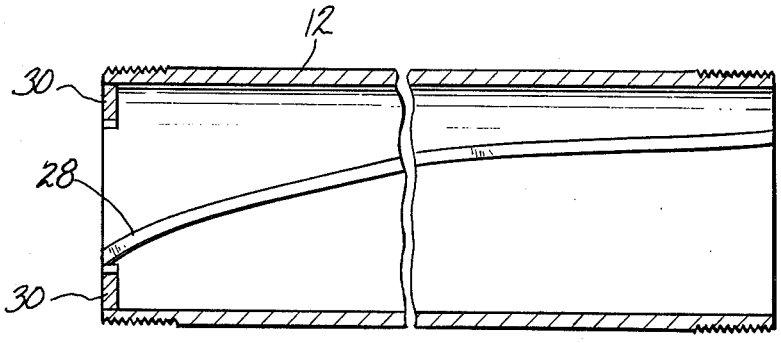
FIG. 4 shows a cross section of the pump casing with an alternate embodiment showing a curved rib.

FIG. 4 shows a cross section of casing 12 having curved rib 28 running lengthwise along the inner wall of casing 12.

Figure 5:
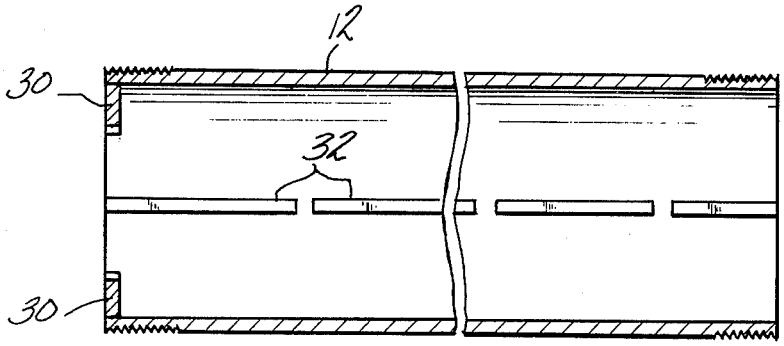
FIG. 5 shows a cross section of the pump casing with an additional embodiment showing a segmented rib.

FIG. 5 shows a cross section of casing 12 in which segments 32 comprise the rib running lengthwise along the inner wall of casing 12.

The principles of the progressing cavity pump are well known and will not be further described.

In the improved pump of the present invention, a rib is attached along a portion of the inner wall of the pump casing. This portion is from about 75 to about 100 percent of the length of the casing which is in contact with the stator. Any suitable material of construction which can be used for the casing may be employed for the rib. The casing is generally made of alloys, such as steel, to withstand the corrosive or abrasive action. The rib may be attached to the casing by any suitable means such as welding.

In a preferred embodiment, at least two ribs are attached along a portion of the casing. Where two ribs are used, they are preferably attached to the casing so that they are diagonally opposite each other. Should a plurality of ribs be used, they can be attached to the casing to provide the desired spacing around the casing. For example, where four ribs are attached to the casing, they can be spaced apart about 90° from each other.

While the rib, as illustrated, is shown as a continuous rectilinear form, it will be readily recognized that the rib can be curved, for example, in the form of a spiral or arc. In addition, the rib may be segmented or divided, if desired to provide notches or grooves to hold or pinch the stator.

The casing with the ribs attached is suitable for use as a mold in which the flexible stator is placed and shaped to the casing. If desired, the stator may have slots or grooves along the sides corresponding to the location of the ribs to envelop the ribs attached to the casing.

During operation of the pump, the progressive action tends to force the stator out of the casing near the outlet. To prevent this, in a further embodiment, a curb is attached to the casing at or near the outlet end. The curb is attached, for example, by welding around a portion of the circumference of the casing. The curb can occupy any suitable portion of the circumference of the casing, but preferably occupies from about 50 to about 100 percent of the circumference. As shown in FIG. 2, the curb may be in sections or, if desired, may be continuous. The height of the curb should be sufficient to prevent the stator from being forced out of the casing while not materially affecting the flow of fluids through the outlet.

While using the improved pump of the present invention, for example, with corrosive liquids such as caustic soda, the stator is prevented from rotating by the ribs in the pump casing and is retained within the casing by curbs, thus avoiding damage to the stator.

What is claimed is:

1. In a helical gear pump wherein an internally helically threaded resilient stator pumpingly coacts with an externally helically threaded rigid rotor, a rigid tubular casing embracing said stator, said casing having an inlet and an outlet, the improvement which comprises means to prevent said stator from rotating within said casing, said means being at least one rib attached along a portion of the inner wall of said casing, said rib being engagingly in contact within groove means in said stator, wherein said rib is curved, and in which said portion is from about 75 to about 100 percent of the length of said casing which is in contact with said stator.

2. In a helical gear pump wherein an internally helically threaded resilient stator pumpingly coacts with an externally helically threaded rigid rotor, a rigid tubular casing embracing said stator, said casing having an inlet and an outlet, the improvement which comprises means to prevent said stator from rotating within said casing, said means being at least one rib attached along a portion of the inner wall of said casing, said rib being engagingly in contact within groove means in said stator, wherein said rib is segmented, and in which said portion is from about 75 to about 100 percent of the length of said casing which is in contact with said stator.

* * * * *